US005967158A

United States Patent [19]

Smith et al.

[11] Patent Number: 5,967,158

[45] Date of Patent: Oct. 19, 1999

[54] DISPENSING DEVICE FOR TABLETS

[75] Inventors: Carol Smith, Brussels; Tanya Cecile Corneel Van Rompuy, Mechelen, both of Belgium; Steven Frederick Kelsey, London, United Kingdom

[73] Assignee: The Procter & Gamble Company, Cincinnati, Ohio

[21] Appl. No.: 08/939,171

[22] Filed: Sep. 29, 1997

[51] Int. Cl.[6] ..... B08B 9/20

[52] U.S. Cl. ..... 134/25.2; 134/25.1; 422/266

[58] Field of Search ..... 134/25.1, 25.2, 134/93; 422/266, 277; 4/227.1, 231; 68/17 R; 206/0.5; 8/158

[56] References Cited

U.S. PATENT DOCUMENTS

| | | | |
|---|---|---|---|
| 126,518 | 5/1872 | Camp | 422/266 |
| 167,769 | 9/1875 | Johnson | 422/266 |
| 177,712 | 5/1876 | Harlow et al. | 422/266 |
| 428,144 | 5/1890 | Russel | 422/266 |
| 942,836 | 12/1909 | Leonard | 422/266 |
| 1,351,273 | 8/1920 | Wood | 422/266 |
| 1,473,783 | 11/1923 | Douglas | 422/266 |
| 5,593,648 | 1/1997 | Christieetal | 422/266 |

FOREIGN PATENT DOCUMENTS

| | | |
|---|---|---|
| 0343069-A1 | 5/1988 | European Pat. Off. . |
| 691102 | 1/1996 | European Pat. Off. . |
| 2324185 | 11/1974 | Germany . |

*Primary Examiner*—Jill Warden
*Assistant Examiner*—Alexander Markoff
*Attorney, Agent, or Firm*—James C. Vago

[57] ABSTRACT

A method of retaining and dispensing a detergent tablet in an automatic washing machine. The method includes the step of providing a dispensing device having a flexible and resilient cage structure which is liquid permeable. Another step is flexibly deforming the cage structure and inserting the detergent tablet in the cage structure such that said detergent tablet is retained therein. Yet another step is placing the dispensing device including the detergent tablet into an automatic washing machine for a washing cycle in which a wash liquor is caused to pass through the cage structure to progressively dissolve and dispense detergent from the detergent tablet.

8 Claims, 2 Drawing Sheets

DISPENSING DEVICE FOR TABLETS

FIELD OF THE INVENTION

The present invention relates to a dispensing device for detergent in tablet form.

BACKGROUND OF THE INVENTION

Detergent compositions formed as non particulate solids such as bars or tablets or briquettes are known in the art. In the following, the term "tablet" will refer to any form of non particulate solids. The tablet provides a number of advantages to both the consumer and the manufacturer. For example, the tablet avoids spillage of the detergent composition. Furthermore, the tablet eliminates the need for the user to estimate the dosage of detergent composition required and ensures that the correct dosage of detergent composition per wash cycle is used by the user.

To further simplify handling and in order to maximize dissolution, thus improving the performance of the detergent tablet, many detergent composition manufacturers provide the consumer with dispensing devices in which to place the detergent tablet prior to being placed in the washing machine. Indeed, dispensing devices in the form of baskets or cradles are often utilized for example in automatic dish washing machines to maximize the performance of the tablet.

An example of a dispensing device for tablets which may be introduced in an automatic dish washing machine is described in co-pending European Patent Application No. 95304115.9. This dipensing device may comprise a fastening means which fastens the dispensing device to the interior of an automatic washing machine such that it can be released therefrom when required. In an automatic dish washing machine the dispensing device is usually attached to the exterior of the cutlery basket or the crockery basket.

Since the detergent composition is already dosed and compacted into tablets, smaller packages can be used for the packaging of the tabletted detergent. Smaller packages mean less space needed for storage and transportation, therefore also logistic and cost improvements of the packaged detergent are achieved. However, part of the logistic and cost improvements may be lost when the dispensing device is included in the packages. Indeed, the volume occupied by the dispensing device has to be further added to the package containing the detergent tablets. Thus, part of the advantage of reducing the space for a package resulting of detergents compacted into tablets is lost when a dispensing device is included in the packages.

Furthermore, the cage-like dispensing device of the co-pending European Patent Application No. 95304115.9 requires quite sophisticated molding techniques. Such a sophisticated molding technique is for example split cavity molding. The use of such sophisticated molding techniques results in high mould costs and correspondingly high cost per piece.

It is therefore an object of the present invention to provide a method for retaining a detergent tablet and dispensing the detergent tablet in a wash liquor in which a dispensing device is supplied occupying less amount of volume in a package and can be produced with a cost efficient process.

SUMMARY OF THE INVENTION

The present invention is a method for retaining a detergent tablet and dispensing the detergent tablet in a wash liquor of an automatic laundry or dish washing machine. The method comprises the following steps:

(a) providing a dispensing device comprising a flexible and resilient cage structure in a flat configuration, wherein the cage structure is liquid permeable;

(b) erecting the cage structure from the flat configuration;

(c) flexibly deforming the erected cage structure so that a detergent tablet can be accepted and retained within the cage structure;

(d) introducing a detergent tablet into the flexibly deformed dispensing device;

(e) placing the dispensing device retaining the detergent tablet into an automatic laundry or dish washing machine for a washing cycle in which the wash liquor is caused to pass through the cage structure to dissolve and dispense the detergent tablet; and (f) reusing the dispensing device for another washing cycle whereby the cage structure is flexibly deformed to introduce a new detergent tablet.

DETAILED DESCRIPTION OF THE INVENTION

In the following any form of non particulate solids such as bars or tablets or briquettes will be encompassed by the term "tablet". The tablet is made from a detergent composition for dish or laundry washing. The tablet may have any shape or dimension. Preferably, the solid, non particulate tablet is symmetrical to ensure the uniform dissolution of the tablet in the wash liquor.

According to the present invention the detergent tablet may comprise any ingredients known in the art. Such ingredients may include surfactants, suds suppressors, bleaches, chelants, builders, enzymes, fillers and perfumes.

According to the present invention the detergent composition of the tablet is prepared in its granular or particulate form and then formed into tablets of the desired shape and size by any one of the methods known in the art. Suitable methods include compression, extrusion and casting. The detergent composition may be homogeneously distributed throughout the tablet or may comprise distinct layers of certain detergent ingredients.

The present invention provides a method for retaining a detergent tablet and dispensing the detergent tablet in a wash liquor of an automatic laundry or dish washing machine. In the following a dispensing device (10) will be described suitable to perform the method according to the present invention. The dispensing device comprises a cage structure for retaining the tablet, so that a liquid passing through the cage structure dissolves and dispenses the tablet. Consequently, the cage structure is a liquid permeable wall. Therefore a detergent tablet contained in the device can be dissolved during a wash cycle, for example, by water. The dissolved detergent tablet forms a wash liquor. This wash liquor is able then to exit the dispensing device to be available in the wash cycle of an automatic dish or laundry washing machine.

The cage structure is manufactured in a flat configuration. The flat configuration of the cage structure enables the cage structure to be manufactured in an easy and cost efficient way. Furthermore, the cage structure in the flat configuration allows the dispensing device to occupy a minimum volume. This means that the dispensing device can be stored in a package without the need for a substantial increase in the available space in a package. Consequently, the size of the package can also be kept to a minimum. The flat configuration is such that the available volume of the cage structure in the flat configuration is not sufficient to retain a detergent tablet. The cage structure according to the present invention is flexible and resilient. The cage structure is erected from the flat configuration before using the dispensing device for the first time to enable a detergent tablet to be accepted and retained within the dispensing device.

Figure 1A:
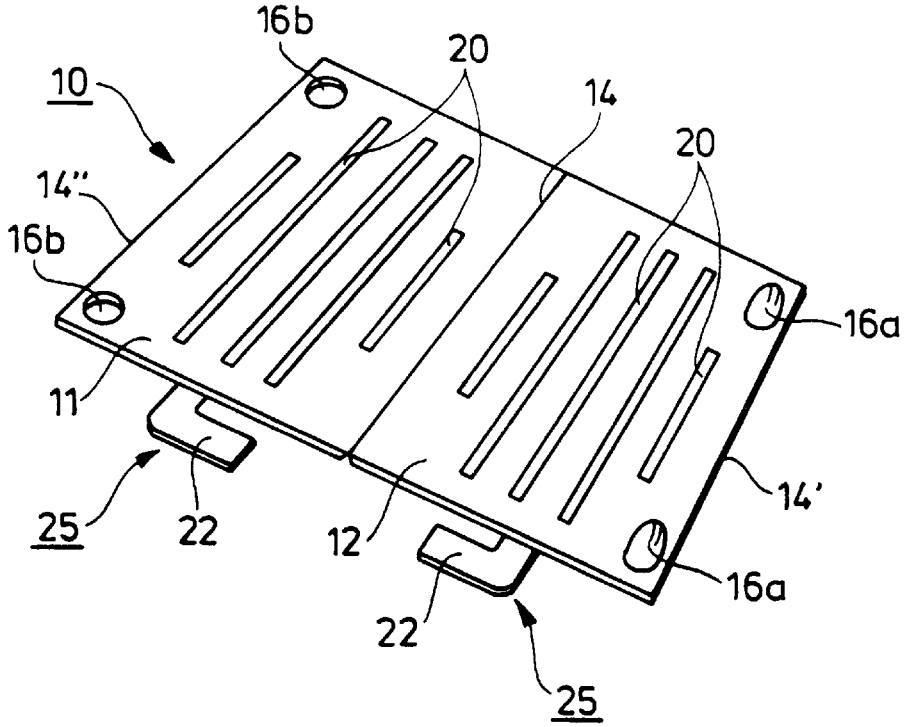
FIG. 1*a* shows a perspective front view of a dispensing device according to the present invention in a flat configuration.
Figure 1B:
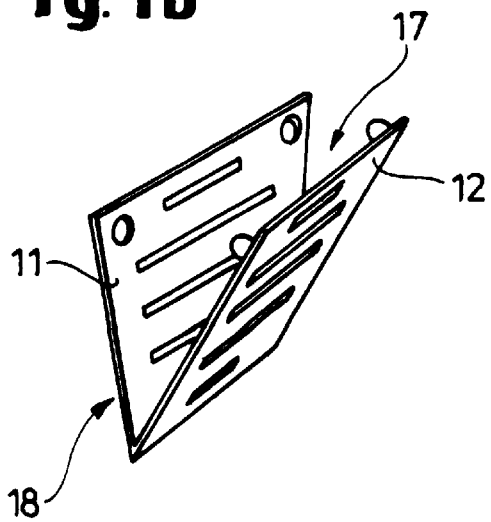
FIG. 1*b* shows in a perspective front view the dispensing device of FIG. 1*a* moved into another flat configuration.

FIGS. 1*a* and 1*b* show a dispensing device (10) in a first embodiment of the present invention. The dispensing device (10) comprises a front wall (11) and a back wall (12). The front wall is attached to the back wall along a side edge (14) common to the front and to the back wall. The front and/or the back wall are movable around the attached side edge (14). FIG. 1*a* shows this embodiment of a dispensing device in a flat configuration. The flat configuration of FIG. 1*a* is obtained directly after manufacturing the cage structure. In this flat configuration the dispensing device occupies a minimum space when stored e.g. in a package. In the flat configuration the cage structure cannot retain a detergent tablet.

In FIG. 1*b* the front (11) and the back walls (12) are turned towards each other around the attached side (14). To keep the cage structure in this folded position, the front wall and/or the back wall comprises engaging means (16). The engaging means keep the front and the back walls together facing against each other. The engaging means may be such to allow a reversible disengagement of the front and back walls from each other. The engaging means may also be a permanent attachment. Preferably, the engaging means may be at least one pin (16*a*) located on the front or back wall. This pin (16*a*) snaps into a corresponding orifice (16*b*) on the other wall.

Although the engaged dispensing device of FIG. 1*b* is the erected position of the dispensing device of FIG. 1*a*, it is another flat configuration of this embodiment. Indeed, the cage structure of FIG. 1*b* is also substantially flat, since the thickness of the cage structure is given only by the folded front and back walls. Furthermore, also this flat configuration is such that the cage structure in this flat configuration is not capable to retain a detergent tablet. Consequently, this is a further possible flat configuration of the cage structure which occupies a minimum space when stored e.g. in a package. The cage structure is delivered in a package in either of the flat configurations shown in FIGS. 1*a* and 1*b*.

The cage structures in the flat configurations of FIGS. 1*a* and 1*b* are not able to accept and to retain a detergent tablet. The cage structure of FIG. 1*a* has first to be erected prior to use to the configuration of FIG. 1*b* and then flexibly deformed. Starting from the flat configuration of FIG. 1*a*, the cage structure has first to be erected into the other flat configuration as depicted in FIG. 1*b*. From the flat configuration of FIG. 1*b*, the side edge (14') and the opposite engaged side edge (14") have to be pressed towards each other so that the front (11) and back (12) walls are outwardly bulged. Consequently, the front and the back walls are distanced from each other through the flexible deformation of the cage structure due to the pressing force on the side edges (14') and (14"). By applying a sufficient pressing force, the front and back walls can be sufficiently outwardly bulged to enable a detergent tablet to be inserted between the front and the back walls.

Once the tablet is inserted between the front and back walls, the pressing force can be released and the tablet is retained between the front and back walls. Indeed, the tablet is blocked between the front and back walls, since the cage structure tends to resiliently flex back into the flat configuration of FIG. 1*b*. The dispensing device can now be placed into an automatic laundry or dish washing machine for a washing cycle in which the detergent tablet is progressively dissolved. Once the detergent tablet is dissolved in a wash liquor, the cage structures returns at least partially into the configuration of FIG. 1*b*. When the dispensing device is reused, the cage structure has again to be flexibly deformed to get a detergent tablet retained between the front and back walls as described before.

Preferably, the front wall and/or the back wall comprise orifices or slits (20). The orifices or slits are such to allow a liquid to pass through the front and/or back walls. This enables the detergent tablet to be dissolved more efficiently. This means that water is able to enter into the dispensing device and reach the detergent tablet inside. The orifices are preferably evenly distributed throughout the hollow body of the device. The orifices are such that the detergent tablet cannot be removed from the dispensing device through the orifices. Nevertheless, the orifices are such to allow water to enter the dispensing device for dissolving the detergent tablet during the wash cycle of the automatic dish or laundry washing machine. These orifices or slits are in addition to the fact that the dispensing device of the embodiment of FIGS. 1*a* and 1*b* is not completely closed in the dispensing position. Indeed, apart from the attached side edge (14) and the engaged side edges (15 and 15'), the other edges viz. the top (17) and the bottom (18) side edges of the dispensing device are not closed.

Figure 2A:
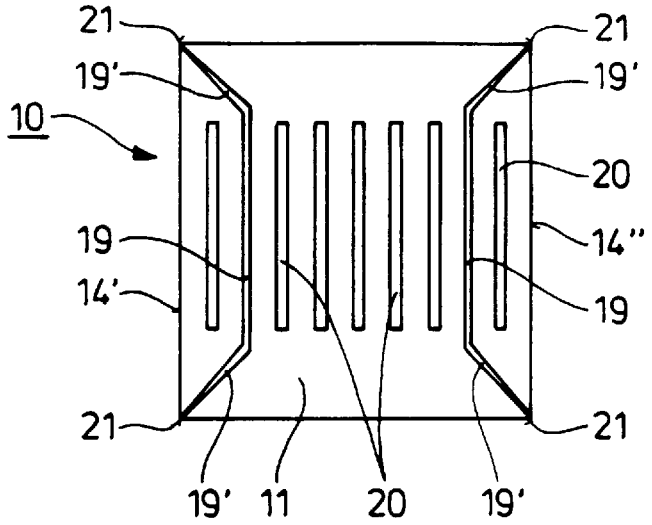
FIG. 2*a* shows a front view of another embodiment of the dispensing device according to the present invention in the flat configuration.
Figure 2B:
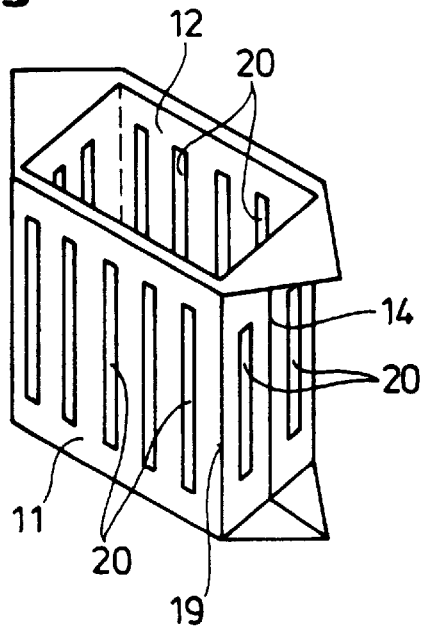
FIG. 2*b* shows in a perspective front view the dispensing device of FIG. 2*a* moved into an erected configuration to accept and retain a detergent tablet.

FIGS. 2*a* and 2*b* show another dispensing device (10) in a second embodiment of the present invention. The dispensing device again comprises a front (11) and a back wall (12). In FIG. 2*a* only the front view with front wall (11) of this embodiment of the dispensing device is shown. The front and back walls both comprise a folding cut (19) on each side edge (14') and (14"). The folding cut is a cut through the thickness of the front and back walls. Preferably, the folding cut further comprises cut extensions (19') directed towards the nearest corners (21) of the front and back walls. FIG. 2*a* shows this embodiment of a dispensing device in the flat configuration. Again, this flat configuration ensures that the dispensing device occupies a minimum space when stored and delivered e.g. in a package before the first use of the dispensing device.

The dispensing device in FIG. 2*a* is deformed to get the erected dispensing device of FIG. 2*b* in the following manner. The side edges (14') and (14") are pressed in the same manner as for the embodiment of FIGS. 1. The front (11) and back (12) walls are distanced from each other from the flat configuration. The pressure on the side edges can be increased until part of the front and back walls are inwardly folded along the folding cut (19) and cut extensions (19') as shown in FIG. 2*b*. FIG. 2*b* is the erected position of the dispensing device of FIG. 2*a*. The parts of the front and back walls located between the side edges (14) and (14') and the folding cut (19) may remain permanently inwardly folded. Alternatively, the cage structure of FIG. 2*b* may be allowed to be deformed again into the flat configuration of FIG. 2*a* when the side edges (14) and (14') are outwardly pushed.

The cage structure in FIG. 2*b* can still be further flexibly deformed so that the front and back walls are outwardly bulged to facilitate the insertion of a detergent tablet. The outward bulging of the front and back walls creates an greater space to facilitate the insertion of a tablet in between the front and back walls. The outward bulging of the front and back walls is achieved by pressing on the side edges (14) and (14'). Once the pressure on the side edges is released, the tablet is blocked between the front and back walls, whereby the dispensing device remains in the open position as shown in FIG. 2*b*. The dispensing device can now be placed into an automatic laundry or dish washing machine for a washing cycle in which the detergent tablet is progressively dissolved. Once the detergent tablet is dissolved in a wash liquor, the cage structures returns at least partially into the unbulged configuration of FIG. 2*b*. When the dispensing device is reused, the cage structure has again to be flexibly deformed to get a detergent tablet retained between the front and back walls as described before.

As for the previous embodiment the front wall (11) and/or the back wall (12) comprise orifices or slits (20). As before, the orifices or slits are such to allow a liquid to pass through the front and/or back walls. This enables the detergent tablet to be dissolved more efficiently. This means that water is able to enter into the dispensing device and reach the detergent tablet inside. The orifices are preferably evenly distributed throughout the walls of the dispensing device. The orifices are such that the detergent tablet cannot be removed from the dispensing device through the orifices. Nevertheless, the orifices are such to allow water to enter the dispensing device for dissolving the detergent tablet during the wash cycle of the automatic dish or laundry washing machine. These orifices or slits are in addition to the fact that the dispensing device of the embodiment of FIGS. 2*a* and 2*b* is not completely closed in the dispensing position. Indeed, the top (17) and the bottom (18) sides of the cage structure are not closed.

As another optional feature of the present invention, the dispensing device comprises fastening means as shown in (25) of FIG. 1*a*. As used herein, fastening means refer to any means which can be adapted to fasten the dispensing device to the interior of e.g. an automatic dish washing machine such that it can be released therefrom when required by the user. The fastening means is preferably made of similar or identical material to that of the dispensing device itself. The fastening means may preferably be located on the front (11) and/or back wall (12) of the dispensing device. The fastening means preferably comprises at least a hook (22), which extends from the front and/or back wall. Preferably, the fastening means is adapted to be fastened on the exterior or interior of the cutlery basket of an automatic dish washing machine.

Preferably, the dispensing device is further provided with securing means. As used herein, securing means refers to any means which can be adapted to secure the dispensing device to the interior of an automatic dish or laundry washing machine such that it cannot be disengaged therefrom during the wash cycle of the automatic washing machine. Specifically, the securing means is adapted to prevent disengagement of the dispensing device due to forces occurring inside an automatic dish washing machine, as for example forces exerted by the circulation of water and/or air. Nevertheless, the securing means does not impede the release of the dispensing device from the interior of an automatic dish or laundry washing machine when required by the user. Preferably, the securing means is adapted to secure the dispensing device on the cutlery basket of an automatic dish washing machine. The securing means is preferably made of similar or identical material as the dispensing device, but being more flexible with respect to the dispensing device itself. Other flexible material, like metals, may be also considered for the purpose of the present invention.

The co-pending U.S. patent application Ser. No. 09/051,338 provides a dispensing device with securing means as defined before. The securing means prevents the dispensing device (10) from disengaging from the cutlery basket. Specifically, the securing means prevents disengagement of the dispensing device in a direction which is opposite to the direction in which the dispensing device is fastened with the fastening means. All the embodiments described as securing means in the U.S. patent application Ser. No. 09/051,338 are herewith incorporated by reference.

The dispensing device of the present invention may be formed from any flexible, water resistant material that can withstand moderately elevated temperatures, such as those reached in automatic washing machines, e.g. about 95° C., for a relatively long period of time (about 3 hours) and which can be formed into the desired shape. Preferably the dispensing device is made of low cost thermoplastic material such as polypropylene or polyethylene and formed by injection molding.

We claim:

1. A method of retaining a detergent tablet in a dispensing device and dispensing detergent therefrom into a wash liquor of an automatic washing machine, said method comprising the steps of:

(a) providing a dispensing device having a flexible and resilient cage structure which is liquid permeable;

(b) flexibly deforming said cage structure and inserting said detergent tablet in said cage structure, wherein said tablet is retained within said cage structure by pressure exerted upon said tablet by said cage structure; and (c) placing said dispensing device including said detergent tablet into an automatic washing machine for a washing cycle in which a wash liquor is caused to pass through said cage structure to progressively dissolve and dispense detergent from said detergent tablet.

2. A method according to claim 1, wherein the cage structure comprises a front wall attached to a back wall along a side edge common to the front and back wall, whereby the side edge allows a folding of the cage structure along the side edge, the front wall and/or the back wall comprising engaging means, the engaging means engaging the front and the back walls together when folding the cage structure so that a detergent tablet is retained between the front and the back walls.

3. A method according to claim 1, wherein the cage structure comprises a front wall, a back wall and a folding cut, the front wall facing the back wall and the front wall connected to the back wall with the side edges, the front and the back walls are distanced from each other from the flat configuration when pressing onto side edges so that a detergent tablet is placed between the front and the back walls.

4. The method of claim 1, wherein said dispensing device is reused for another washing cycle after said detergent tablet has dissolved.

5. The method of claim 1 wherein said cage structure is initially in a flat configuration and is first erected before inserting said detergent tablet.

6. The method of claim 1 wherein tablet dissolving efficiency is improved by providing slits in said cage structure.

7. The method of claim 1 wherein tablet dissolving efficiency is improved by providing orifices in said cage structure.

8. The method of claim 1 wherein said cage structure further comprises a means for releasably fastening said dispensing device to an interior of said automatic washing machine such that said dispensing device remains secured thereto during said wash cycle.

* * * * *